United States Patent [19]

Sato

[11] 4,380,691

[45] Apr. 19, 1983

[54] MAIN SWITCH FOR TAPE RECORDER

[75] Inventor: Masanobu Sato, Hachioji, Japan

[73] Assignee: Olympus Optical Co., Ltd., Tokyo, Japan

[21] Appl. No.: 301,224

[22] Filed: Sep. 11, 1981

[30] Foreign Application Priority Data

Sep. 19, 1980 [JP] Japan ..... 55-133178[U]

[51] Int. Cl.[3] ..... H01R 33/30

[52] U.S. Cl. ..... 200/51 R; 200/51.1; 200/61.58 R; 200/155 R

[58] Field of Search ..... 200/51 R, 51.09, 51.1, 200/153 LB, 155, 336, DIG. 34, 329, 61.19, 200/61.58 R, 61.59

[56] References Cited

U.S. PATENT DOCUMENTS

| | | | |
|---|---|---|---|
| 2,991,343 | 7/1961 | Norden | 200/153 LA |
| 3,204,053 | 8/1965 | Bilek | 200/51.09 |
| 3,749,447 | 7/1973 | Renaud | 200/51.1 |
| 4,025,738 | 5/1977 | Erwin et al. | 200/153 LB |

*Primary Examiner*—John W. Shepperd

*Attorney, Agent, or Firm*—Frishauf, Holtz, Goodman and Woodward

[57] ABSTRACT

In a tape recorder provided with a power jack which includes a rod-like conductive member, a relay conductive member insulated from the rod-like conductive member, and an elastic conductive member having elasticity and being capable of moving a first position, at which the elastic conductive member is separated from the relay conductive member by inserting a plug to the power jack, and a second position, at which is in contact with and electrically connected to the relay conductive member, a main switch for the tape recorder comprises a cylindrical rotary member having an inner periphery, an outer periphery and a recess formed in the outer periphery. The rotary member is adapted to snugly fit on the rod-like conductive member of the power jack when inserted thereinto, and is rotatable on and about the rod-like conductive member between a first position, at which the outer periphery and the elastic conductive member are in contact with each other and the elastic conductive member is located in the first position, and a second position, at which the recess corresponds to and face the elastic conductive member to locate the elastic conductive member in the second position.

3 Claims, 12 Drawing Figures

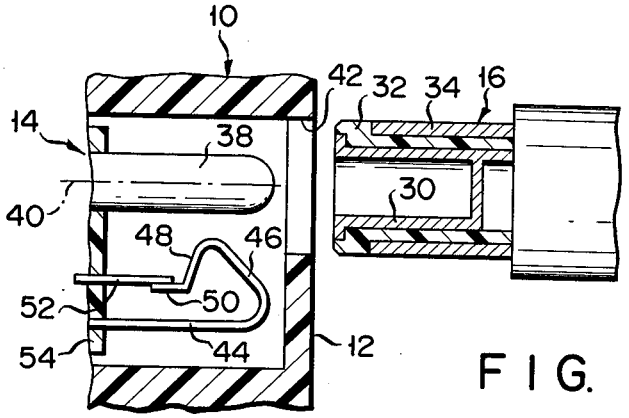
FIG. 2
FIG. 3
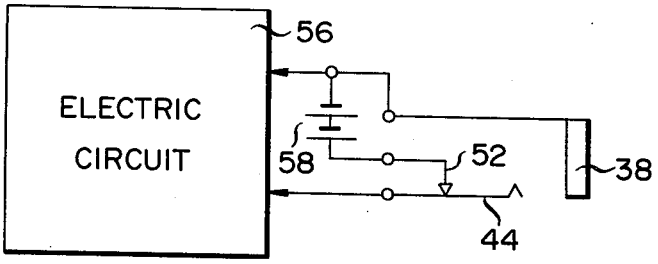
FIG. 4
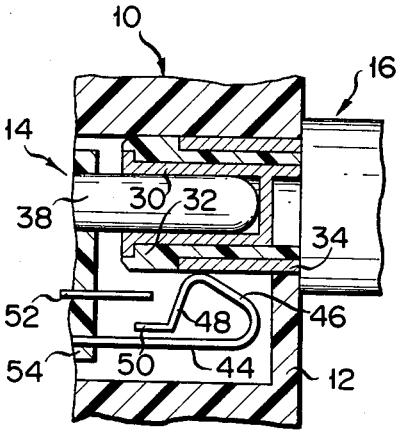

MAIN SWITCH FOR TAPE RECORDER

BACKGROUND OF THE INVENTION

This invention relates to main switches for tape recorders and, more particularly, to main switches using power jacks for tape recorders provided with power jacks.

Recently, various portable tape recorders that can be put in a briefcase or suit pockets have been sold. Some of these tape recorders have as small a housing size and shape as possible to provide for better portability.

In such tape recorders, the main switch is omitted so that the outer size may be smaller.

When such a tape recorder without a main switch is carried in a briefcase or suit pocket, however, it is likely that its buttons (or switches), such as the play button (or switch), fast feed button (or switch) or rewind button (or switch), are struck and depressed by various objects which are carried together in the briefcase or suit pocket.

If occasional depression of buttons or switches of the tape recorder occurs, power is supplied from the battery contained in the tape recorder to the motor therefor. In such a case, the battery may be consumed while the tape recorder is carried. Since the motor of the tape recorder consumes considerable power, once this occurs, it is likely that the tape recorder no longer provides its function when it is subsequently desired to use the tape recorder.

SUMMARY OF THE INVENTION

The invention is intended in the light of the above, and its object is to provide a main switch for tape recorder, which is constructed to make use of the power jack of the tape recorder and can prevent wasteful consumption of the battery power while the tape recorder is carried without altering the recorder housing shape and size.

BRIEF DESCRIPTION OF THE DRAWINGS

FIG. 2 is a sectional view showing the section of the power jack taken along line II*a*—II*a* in FIG. 1 and the section of the plug taken along line II*b*—II*b* in FIG. 1;

FIG. 3 is a wiring diagram showing the wiring of the power jack, tape recorder power supply and electric circuit;

FIG. 4 is a sectional view showing the power jack of FIG. 2 and the plug in its state inserted in the jack;

DETAILED DESCRIPTION OF THE PREFERRED EMBODIMENT

Figure 1:
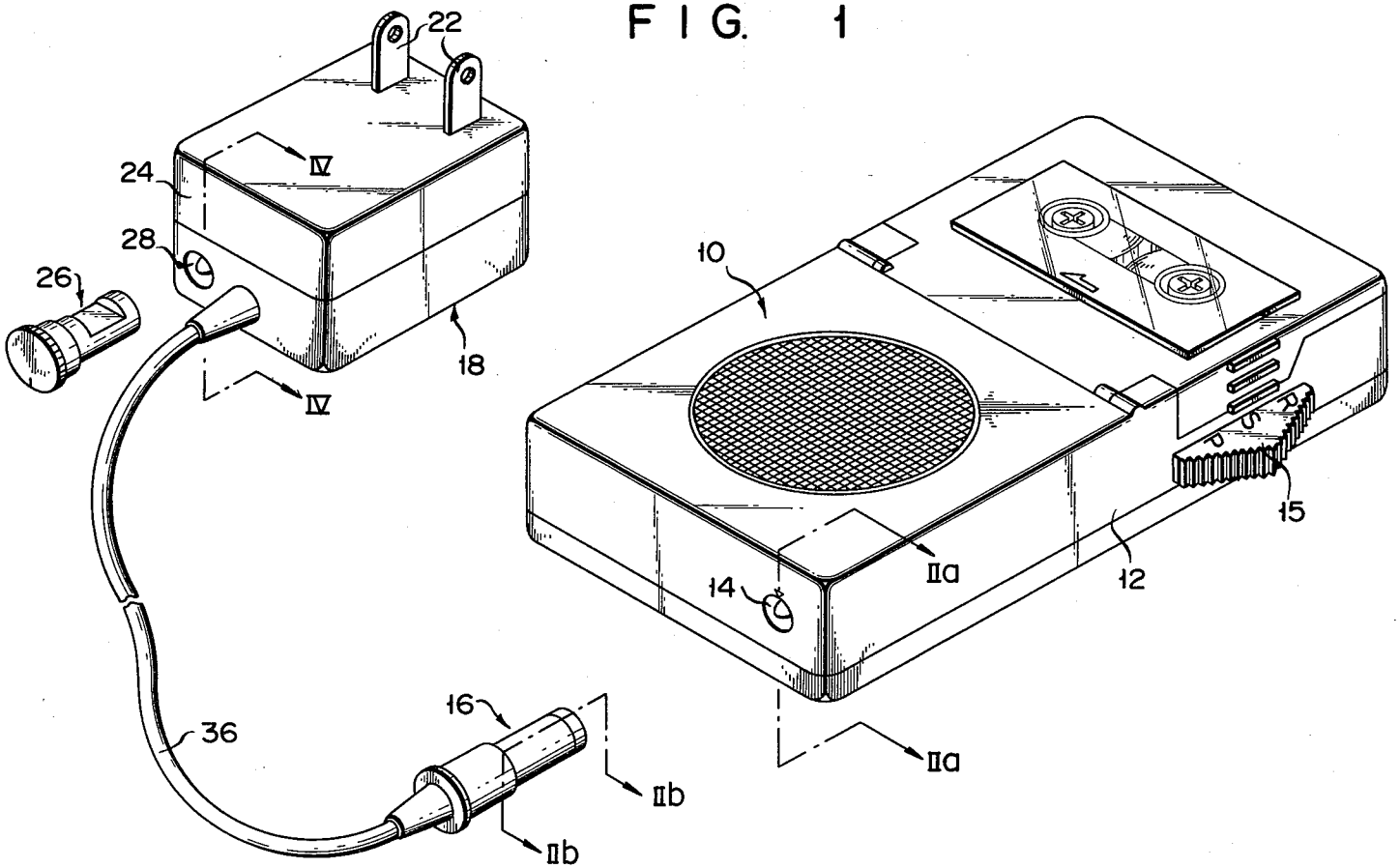
FIG. 1 is a perspective view showing a rotary member embodying the invention, a tape recorder provided with a power jack, and a plug inserted in the power jack embodying the invention.

FIG. 1 shows a tape recorder 10 to which the invention is applied. The tape recorder 10 is used with a tape cassette which is called a microcassette, and it is operated with a direct current. As shown in FIG. 1, the housing 12 of the tape recorder 10 is provided with a power jack 14 and a switch for selecting a play operation, a stop operation and a rewind operation. In FIG. 1, a plug 16 which is to be inserted into the power jack 14 is also shown. The plug 16 is connected by a code 36 to an alternating current adapter 18, which has a housing 24 accommodating a rectifier (not shown) for converting alternating current received at a pair of terminals 22 into direct current and also a transformer for converting the voltage produced from the rectifier into the voltage for the tape recorder 10. In FIG. 1, there is further shown a rotary member 16, which constitutes an embodiment of the main switch according to the invention. As is shown in FIG. 1, the housing 24 is provided with a rotary member retainer section 28 for removably retaining the rotary member 26.

As shown in FIG. 2, the plug 16 is a hollow cylindrical member. The inner periphery of the plug 16 is constituted by a first conductive member 30 having a cylindrical shape and made of a metal or like conductive material. The first conductive member 30 is entirely fitted in a cylindrical insulating member 32. In this embodiment, the insulating member 32 is made of a synthetic material. Intermediate and stem portions of the insulating member 32 are fitted in a second conductive member 34 having a cylindrical shape and made of a metal or like conductive material. As is shown in FIG. 2, the outer periphery of the second conductive member 34 is flush with the outer periphery of a tip portion of the insulating member 32, that is, the outer periphery of the tip portion of the insulating member 32 and the outer periphery of the second conductive member 34 constitute the outer periphery of the plug 16. The first and second conductive members 30 and 34 are connected by the aforementioned connection code 36 to the alternating current adapter 18, and they are insulated from each other by the insulating member 32. The alternating current adapter 18 exclusive of the rotary member retainer section 28 and the plug 16 having the construction described above are well known in the art.

As shown in FIG. 2, the power jack 14 has a rod-like conductive member 38 accommodated in the housing 12 of the tape recorder 10. The conductive member 38 is made of a metal or like conductive material. It is adapted to snugly fit into the plug 16 in contact therewith. The longitudinal center line 40 of the conductive member 38 extends to cross outer surface of the tape recorder housing 12 as shown in FIG. 2. The housing 12 is formed with a hole 42, and the plug 16 can be inserted through the hole 42.

The tape recorder housing 12 accommodates an elastic conductive member 44 which is made of an elastic conductive material, such as metal, extends along the center line 40 in FIG. 2. The elastic conductive member 44 has a first bent portion 46, which extends in a direction toward the center line 40 and away from the aforementioned outer surface of the housing 12 and terminates in a second bent portion 48, which extends in a direction away from the center line 40 and also away from the outer surface of the housing 12 and terminates in a third bent portion 50, which extends along the center line 40. As shown in FIG. 2, the first, second and third bent portions 46, 48 and 50 of the elastic conductive member 44 is spaced apart from the conductive member 38 and also from the rest of the elastic conductive member 44.

The tape recorder housing 12 accommodates a relay conductive member 52 which is made of a metal or like conductive material as mentioned earlier and extends along the center line 40. The relay conductive member 52 is electrically connected to the elastic conductive member 44, with its end portion nearer the aforementioned outer surface of the housing 12 in contact on the side further from the center line 40 with the surface of the third bent portion of the elastic conductive member 44 on the side nearer the center line 40.

The other ends of the rod-like conductive member 38, elastic conductive member 44 and relay conductive member 52 are secured to a chassis 54 accommodated in the housing 12 of the tape recorder 10.

As shown in FIG. 3, the rod-like conductive member 38 is electrically connected to an input terminal of an electric circuit 56, which is accommodated in the housing 12, and is also electrically connected to one pair of terminals of a power supply 58, a battery in the instant embodiment, also accommodated in the housing 12. The relay conductive member 52 is electrically connected to the other one of the pair input terminals of the power supply 58. The elastic conductive member 44 is electrically connected to an input terminal of the electric circuit 56. The above construction of the power jack 14 is well known in the art.

When the plug 16 is inserted through the hole 42, the outer surface of the rod-like conductive member 38 of the power jack 14 is contacted by the inner periphery of the first conductive member 30 of the plug 16, as shown in FIG. 4. Thus, the first conductive member 30 and conductive member 38 are electrically connected to each other. At this time, the borderline portion between the first and second bent portions 46 and 48 of the elastic conductive member 44 is contacted by the outer periphery of the plug 16 and displaced thereby in a direction away from the center line 40 against the spring force of the member 44, as shown in FIG. 4. With this displacement, the third bent portion 50 of the elastic conductive member 44 is separated from the relay conductive member 52 of the power jack 14, which is spaced apart from the first and second conductive members 30 and 34 of the plug 16, thus releasing the electrical connection between the relay conductive member 52 and elastic conductive member 44. That is, the supply of current from the power supply 58 to the electrical circuit 56 is cut off. The position of the elastic conductive member 44 at this time is referred to as first position.

In this first position of the elastic conductive member 44, which is attained when the plug 16 is completely inserted into the power jack 14, the borderline portion between the first and second bent portions 46 and 48 of the elastic conductive member 44 is in contact with the second conductive member 44 of the plug 16. In this way, the elastic conductive member 44 and second conductive member 34 are electrically connected to each other. Thus, direct current is supplied from the alternating current adapter 18 to the electrical circuit 56 through the rod-like conductive member 38 electrically connected to the first conductive member 30 of the plug 16 and the elastic conductive member 44 electrically connected to the second conductive member 34 of the plug 16.

When the plug 16 is removed from the power jack 14, as shown in FIG. 2, the electrical connection between the first conductive member 30 of the plug 16 and the rod-like conductive member 38 of the power jack 14 and also the electrical connection between the second conductive member 34 of the plug 16 and the elastic conductive member 44 of the power jack 14 are released. At this time, the borderline portion between the first and second bent portions 46 and 48 of the elastic conductive member 44 is moved toward the center line 40 by the spring force of the member 44. With this displacement, the third bent portion 59 of the elastic conductive member 44 is brought into contact with the relay conductive member 52, as shown in FIG. 2. Thus, the elastic conductive member 44 and relay conductive member 52 are connected again to each other, and current is supplied from the power supply 58 to the electrical circuit 56 shown in FIG. 3. The position of the elastic conductive member 44 at this time is referred to as second position.

Figure 5:
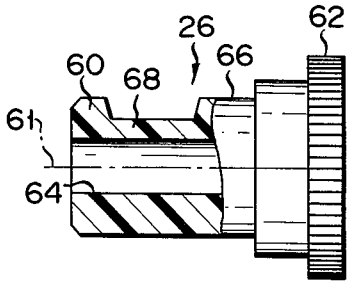
FIG. 5 is an elevational view, partly in section, showing a rotary member.

FIG. 5 shows the rotary member 26 in detail. It comprises a body 60 having a cylindrical shape and a knob 62 coaxial therewith. The shape and size of the inner periphery 64 of the body 60 is the same as the shape and size of the outer periphery of the rod-like conductive member 38 of the power jack 14. The body 60 is adapted to be snugly fitted onto the conductive member 38 of the power jack 14 and be in contact therewith. The outer periphery 66 of the body 60 is formed with a recess 68 shown in FIGS. 1 and 5. In this embodiment, the knob 62 has a disc-like form having a greater diameter than the diameter of the outer periphery 66 of the body 60, and its outer periphery is formed with anti-slip indentations. In this embodiment, the rotary member 26 is made of a nonconductive synthetic resin, that is, the outer periphery 66 of the body 60 is nonconductive.

Figure 6:
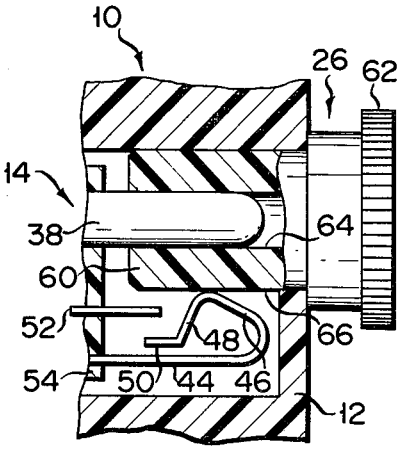
FIG. 6 is a sectional view showing the power jack of FIG. 2 and the rotary member of FIG. 5 in the first position thereof in the power jack.
Figure 7:
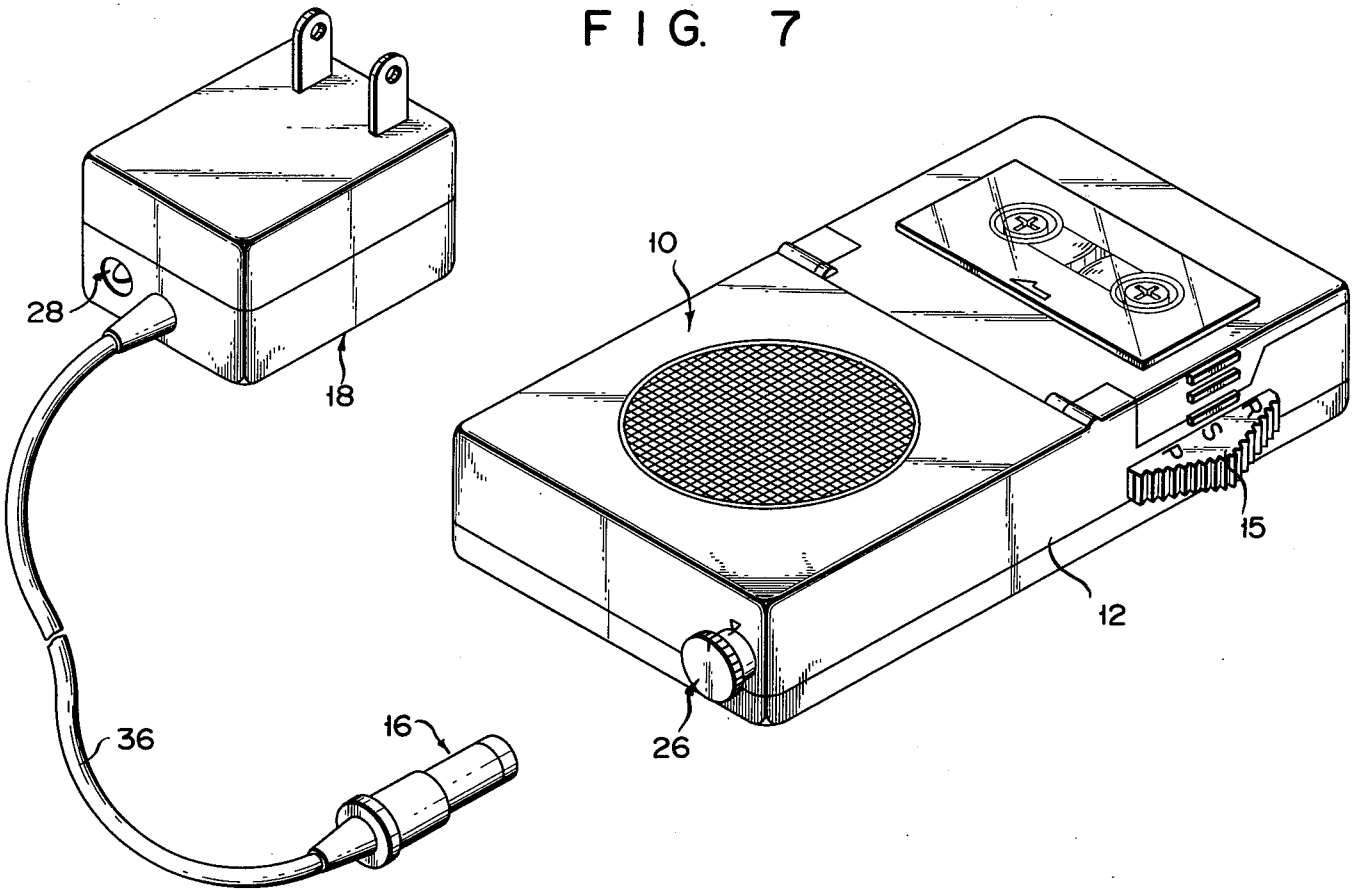
FIG. 7 is a perspective view showing the tape recorder, alternating current adapter and rotary member of FIG. 1 with the rotary member inserted in the power jack of the tape recorder.

The rotary member 26 can be inserted into the power jack 14 through the hole 42 as shown in FIGS. 6 and 7. At this time, the inner periphery 64 of the body 60 of the rotary member 26 is snugly fitted on the outer periphery of the conductive member 38 of the power jack 14. Also, the borderline portion between the first and second bent portions 46 and 48 of the elastic conductive member 44 is contacted with the outer periphery 66 of the body 60 and displaced thereby in the direction away from the center line 40 of the conductive member 38 against the spring force of the member 44. With this displacement, the third bent portion 50 of the elastic conductive member 44 is separated from the relay conductive member 52, as shown in FIG. 6, and thus the electrical connection between the relay conductive member 52 and the elastic conductive member 44 is released. The position of the rotary member 26 at this time is referred to as its first position.

With the rotary member 26 in its first position as shown in FIG. 6, no current is supplied from the power supply 58 to the electrical circuit 56 shown in FIG. 3. Thus, so long as this state is held while the tape recorder 10 is carried in a briefcase or a suit pocket, the electrical circuit 56 will never be supplied with current from the power supply 58 even in the event if the selection 15 of the tape recorder 10 is occasionally struck by an object in the briefcase or suit pocket and switched to select a play mode or rewind mode. In other words, so long as the rotary member 26 is held in its first position mentioned above, the power supply 58, i.e., battery, will never be wastefully consumed until the selection switch 15 is selected to operate the tape recorder 10.

Figure 8:
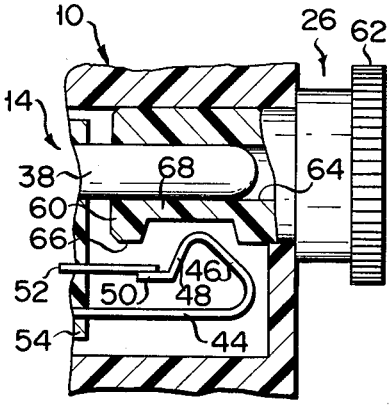
FIG. 8 is a sectional view showing the power jack of FIG. 2 and the rotary member of FIG. 5 in the second position thereof in the power jack.

When the rotary member 26 is rotated about the rod-like conductive member 38, the recess 68 of the body 60 is brought to a position corresponding to the borderline portion between the first and second bent portions 46 and 48 of the elastic conductive member 44 as shown in FIG. 8. At this time, the borderline portion between the first and second bent portions 46 and 48 of the elastic conductive member 44 is allowed to be displaced toward the center line 40 by the spring force of the member 44. With this displacement, the bent portion 50 of the elastic conductive member 44 is brought into contact with the relay conductive member 52, that is, the elastic conductive member 44 and relay conductive member 52 are electrically connected, whereby current is supplied from the power supply 58 to the electrical circuit 56 shown in FIG. 3. The position of the rotary member at this time is referred to as its second position.

When the rotary member 26 is in its second position, by switching the selection switch 15 of the tape recorder 10 to select the play mode or rewind mode the play or rewind operation of the tape recorder 10 is obtained with direct current supplied from the power supply 58.

Figure 9:
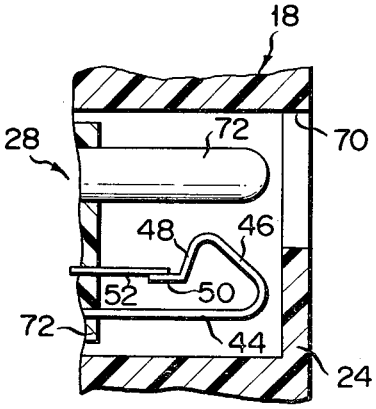
FIG. 9 is a sectional view taken along line IV—IV in FIG. 1.
Figure 10:
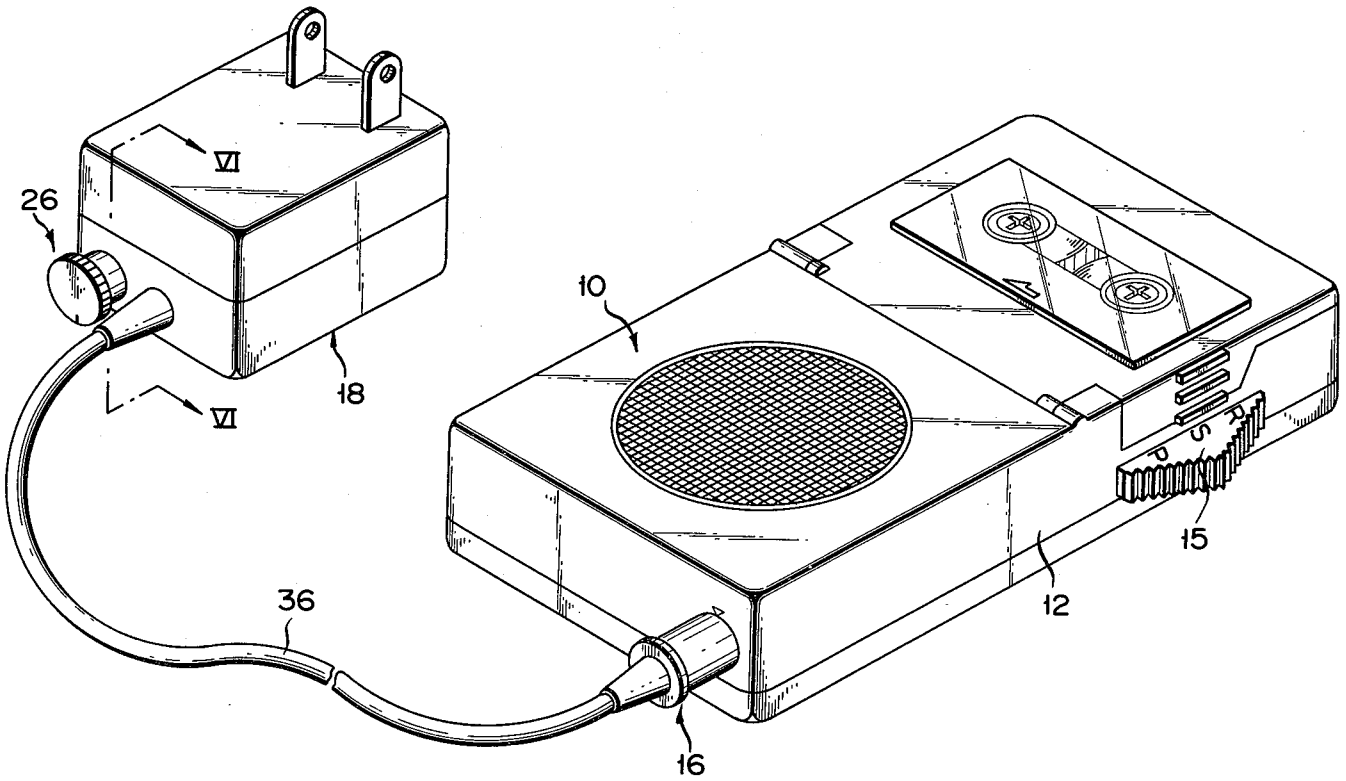
FIG. 10 is a perspective view showing the tape recorder, alternating current adapter and rotary member of FIG. 1 with the plug of the adopter inserted in the power jack of the tape recorder and the rotary member inserted in the retaining section of the adapter.
Figure 11:
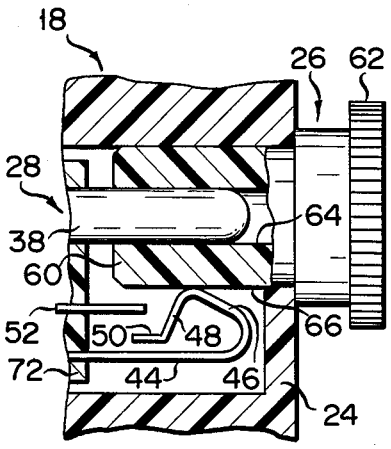
FIG. 11 is a sectional view taken along line VI—VI in FIG. 10, showing the rotary member in the first position thereof.
Figure 12:
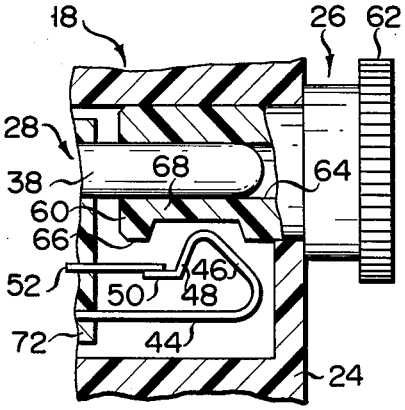
FIG. 12 is a sectional view showing the rotary member of FIG. 11 in the second position thereof.

In this embodiment, the rotary member retaining section 28 provided in the housing 24 of the alternating current adapter 18 includes a hole 70, which is formed in the housing 24, as shown in FIG. 9. The rotary member 24 can be inserted into this hole 70. As shown in FIG. 9, the alternating current adapter housing 24 accommodates a rod-like conductive member 38, a relay conductive member 52 and an elastic conductive member 44, parts being the same construction and arrangement as those of the power jack 14. These parts are secured to a chassis 72 accommodated in the housing 24. However, they are insulated from various electric parts accommodated in the housing 24 such as the aforementioned transformer and rectifier (which are not shown). When the plug 16 of the alternating current adapter 18 is inserted in the power jack 14 of the tape recorder 10 as shown in FIG. 10, the rotary member 26 is retained in the retaining section 28 of the alternating current adopter 18. When the rotary member 26 inserted in the retaining section 28 is in its position shown in FIG. 11, in which the outer periphery 66 of the body 60 is in contact with the borderline between the first and second bent portions 46 and 48 of the elastic conductive member 44, the inner periphery of the body 60 is held against the outer periphery of the rod-like conductive member 38 by the spring force of the elastic conductive member 44. Thus, in this state the rotary member 26 is retained in the retaining section 28 by the frictional forces between the outer periphery of the conductive member 38 and the inner periphery 64 of the body 60 and also the frictional forces between the outer periphery of the body 60 and the aforementioned borderline portion of the elastic conductive member 44. Further, when the rotary member 26 in its position shown in FIG. 12, with the recess 68 of the body 60 at the position corresponding to the borderline portion between the first and second bent portions of the elastic conductive member 44, tends to be moved along the center line 40 of the rod-like conductive member 38, its portion between its recess 68 and outer periphery 66 strikes the aforementioned borderline portion. Thus, the detachment of the rotary member 26 from the retaining section 28 is prevented.

Also, when the rotary member 26 is inserted in the power jack 14 of the tape recorder 10, its detachment from the power jack 14 is prevented for the same reason as when it is in the retaining section 28.

As has been described in the foregoing, according to the invention the main switch for a tape recorder is provided with a power jack, into which a cylindrical plug is inserted, the cylindrical plug including a first conductive member mounted on the inner periphery of the plug, an insulating member mounted on the top end portion of the outer peripheral surface of the plug, and a second conductive member mounted on the intermediate portion of the outer peripheral surface of the plug and constituting a part of the outer peripheral surface and being insulated from the first conductive member, and which includes a rod-like conductive member adapted to snugly fit in the inner periphery of the plug and be electrically connected to the first conductive member, a relay conductive member insulated with respect to the first and second conductive members of the plug, and an elastic conductive member having elasticity and capable of assuming a first position, at which the elastic conductive member is in contact with and electrically connected to the second conductive member of the plug inserted and is separated from the relay conductive member, and a second position, which results from the removal of the plug from the jack and at which the elastic conductive member is in contact with and electrically connected to the relay conductive member.

A main switch for the tape recorder comprises a cylindrical rotary member having an inner periphery, an outer periphery and a recess formed in said outer periphery and adapted to snugly fit on said rod-like conductive member of the power jack when inserted thereinto, said rotary member being rotatable on and about said rod-like conductive member between a first position, at which said outer periphery and said elastic conductive member are in contact with each other and said elastic conductive member and said relay conductive member are separated and insulated from each other, and a second position, at which said recess corresponds to and face said elastic conductive member and said elastic conductive member and said relay conductive member are in contact with and electrically connected to each other.

Thus, it is possible to prevent the wasteful consumption and deterioration of the battery while the tape recorder is carried, without altering the shape and size of the housing of the conventional tape recorder, since portability is important.

With the main switch for a tape recorder according to the invention, it is preferred that the cylindrical plug 16 is electrically connected to the transformer and that the rotary member retaining section 28 for rotatably retaining the rotary member 26 is provided in the housing 24 accommodating the transformer.

This arrangement is desired in view of the prevention of loss of the rotary member 26 while the plug 16 is inserted in the power jack of the tape recorder 10 instead of the rotary member 26.

Further, with the main switch for the tape recorder according to the invention the rotary member retaining section preferably includes a hole formed in the housing, through which the rotary member can be inserted, a retaining member accommodated in the housing and adapted to snugly fit in the inner periphery of the rotary member, and an elastic member adapted to elastically urge or be found to correspond to and face a recess formed in the outer periphery of the rotational member.

With this construction, the rotary member retaining section is simplified in construction. In addition, the rotary member can be reliably retained in the retaining section. Further, the rotary member can be readily removed from the retaining section.

The above embodiment of the invention is by no means limitative, and various changes and modifications can be made without departing from the scope and spirit of the invention.

For example, the recess 68 formed in the outer periphery 66 of the body 60 of the rotary member 26 may be semi-circular in section along the center line 61 of the body 60 as well. In general, the recess 68 may have any shape so long as it will not contact the borderline portion of the first and second bent portions 46 and 48 of the well-known elastic conductive member 44 when the rotary member 28 is completely inserted into the power jack 14 of the tape recorder 10 as shown in FIG. 6.

Further, it is possible to electrically connect the relay conductive member 52 and elastic conductive member 44 of the retaining section 28 of the alternating adapter 18 to the pair of terminals of the secondary coil of the aforementioned transformer not shown and use the rotary member retaining section 28 as the main switch for the alternating current adapter 18 when the rotary member 26 is inserted in the retaining section 28.

Further, the first conductive member 30 of the plug 16 may be constituted by a plurality of elastic conductive members extending along the center line of the plug 16 and curved from the inner periphery thereof toward the center line.

What is claimed is:

1. In a tape recorder provided with a power jack, into which a cylindrical plug including a first conductive member mounted on the inner periphery of the plug, an insulating member mounted on the top end portion of the outer peripheral surface of the plug, and a second conductive member mounted on the intermediate portion of the outer peripheral surface of the plug and constituting a part of the outer peripheral surface and being insulated from the first conductive member, is inserted, and which includes a rod-like conductive member adapted to snugly fit in the inner periphery of the plug and be electrically connected to the first conductive member, a relay conductive member insulated with respect to the first and second conductive members of the plug, and an elastic conductive member having elasticity and capable of assuming a first position, at which the elastic conductive member is in contact with and electrically connected to the second conductive member of the plug inserted and is separated from the relay conductive member, and a second position, which results from the removal of the plug from the jack and at which the elastic conductive member is in contact with and electrically connected to the relay conductive member, a main switch for the tape recorder comprising a cylindrical rotary member having an inner periphery, an outer periphery and a recess formed in said outer periphery and adapted to snugly fit on said rod-like conductive member of the power jack when inserted thereinto, said rotary member being rotatable on and about said rod-like conductive member between a first position, at which said outer periphery and said elastic conductive member are in contact with each other and said elastic conductive member and said relay conductive member are separated and insulated from each other, and a second position, at which said recess corresponds to and faces said elastic conductive member and said elastic conductive member and said relay conductive member are in contact with and electrically connected to each other.

2. The main switch for tape recorder according to claim 1, wherein said cylindrical plug is electrically connected to a transformer accommodated in a housing, said housing being provided with a rotary member retaining section for removably retaining said rotary member.

3. The main switch for tape recorder according to claim 2, wherein said rotary member retaining secton includes a hole provided in said housing, said rotary member being inserted through said hole, a retaining member accommodated in said housing and snugly fitting in the inner periphery of said rotary member, and an elastic member adapted to elastically urge the outer periphery of said rotary member and capable of being inserted in said recess when the rotary member is inserted through said hole.

* * * * *